US005193807A

United States Patent [19]

Schilling et al.

[11] Patent Number: 5,193,807

[45] Date of Patent: Mar. 16, 1993

[54] PINBALL GAME CABINET

[75] Inventors: Winston H. Schilling, Park Ridge; John W. Skalon, Des Plaines, both of Ill.

[73] Assignee: Williams Electronics Games, Inc., Chicago, Ill.

[21] Appl. No.: 848,752

[22] Filed: Mar. 10, 1992

[51] Int. Cl.[5] ..... A63F 7/22; A47B 88/00

[52] U.S. Cl. ..... 273/121 R; 273/121 A; 312/325; 312/327

[58] Field of Search ..... 273/118 R, 118 A, 119 R, 273/119 A, 121 R, 121 A; 49/260, 261, 257, 258; 16/231, 232, 257, 258, 363; 312/310, 311, 314, 315, 317, 322, 323, 325, 327, 351, 252

[56] References Cited

U.S. PATENT DOCUMENTS 3,401,992 9/1968 Benson et al. ..... 312/325

4,936,580 6/1990 Kaminkow ..... 273/121 A

*Primary Examiner*—V. Millin

*Assistant Examiner*—Raleigh W. Chiu

*Attorney, Agent, or Firm*—Rockey, Rifkin and Ryther

[57] ABSTRACT

The playfield is supported on a moving pivot that allows the playfield to move linearly away from the back box as it rotates away from the cabinet such that the playfield can pivot through an angle greater than 90°. The moving pivot includes a pivot pin fixed to the wall of the cabinet which slidably engages a rail fixed to the underside of the playfield. The rail terminates in a locking mechanism that engages the pivot pin when the playfield is moved linearly to thereby fix the playfield to the pivot pin such that the playfield is capable only of pivoting motion.

15 Claims, 5 Drawing Sheets

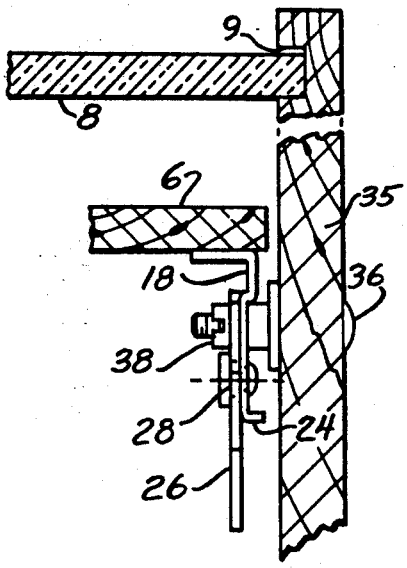
FIG. 2
FIG. 1
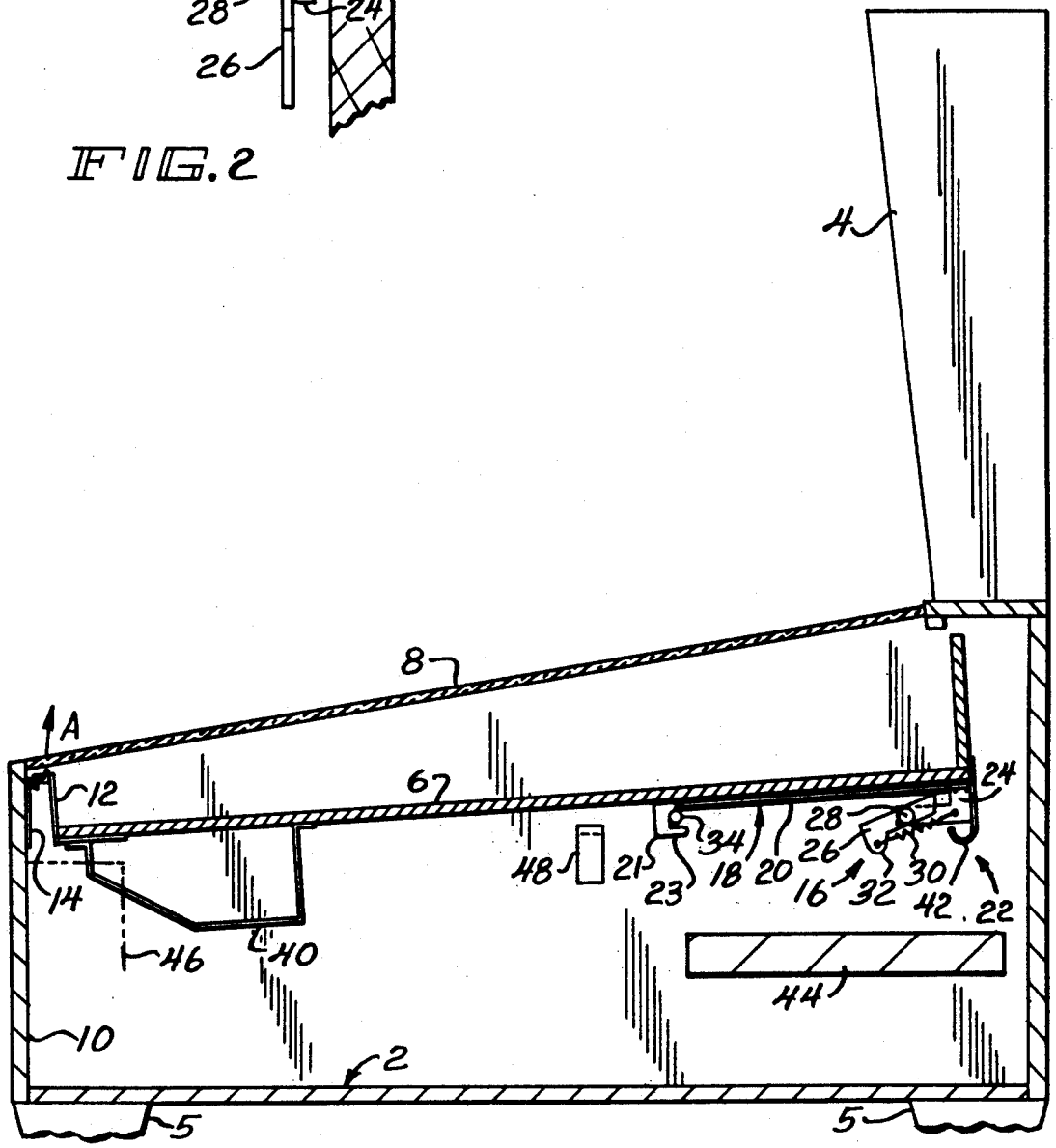

PINBALL GAME CABINET

BACKGROUND OF THE INVENTION

The invention relates generally, to pinball games and, more particularly, to an improved cabinet for such games.

Pinball games consist generally of an inclined playfield that supports a rolling ball and a plurality of play features such as targets, bumpers, ramps and the like. Player controlled flippers are also mounted on the playfield to control the movement of the ball. At the end of the cabinet opposite the flippers is the back box that includes the score display, lighted artwork and other game information. The playfield is supported in a game cabinet and is covered by a plate of glass. Inside of the game cabinet are the mechanical and electrical components that control the operation of the game, many of which are secured directly to the underside of the playfield.

Because pinball games contain relatively complex mechanical and electrical components and are subject to severe use, the machines require periodic maintenance. In order to access the electrical and mechanical components, the playfield glass is first removed and the playfield is then pivoted relative to the cabinet about a horizontal axis. In existing machines this axis is fixed near the end of the playfield closest to the back box. Because of spacial constraints, however, the existing configuration can only be rotated approximately 45° degrees. As a result, access to the rear of the cabinet and playfield is limited, making repair and maintenance work more difficult. Moreover, it is necessary to use a separate prop to hold the playfield in the open position. See, for example, U.S. Pat. No. 4,936,580. Finally, the height to which the play features can extend above the playfield is limited by the fact that the playfield pivots so closely adjacent to the back box such that tall play features may strike the back box causing damage to the back box and the play feature.

Thus, an improved pinball game cabinet construction that facilitates access to the interior of the cabinet is desired.

SUMMARY OF THE INVENTION

The pinball game cabinet of the invention overcomes the above-noted shortcomings of the prior art by supporting the playfield on a moving pivot that allows the playfield to move away from the back box as it is pivoted relative to the cabinet such that the playfield can move through an angle of more than 90°. As a result, access to the interior of the cabinet is greatly enhanced and the playfield can remain open without a separate prop. Moreover, because the playfield moves away from the back box, taller playfield features can be used without damage to the game.

BRIEF DESCRIPTION OF THE DRAWINGS

FIG. 1 is a side sectional view of the cabinet illustrating the moving pivot of the invention.

FIG. 2 is an enlarged side elevated view of the moving pivot of the invention.

DETAILED DESCRIPTION OF THE INVENTION

Figure 3A:
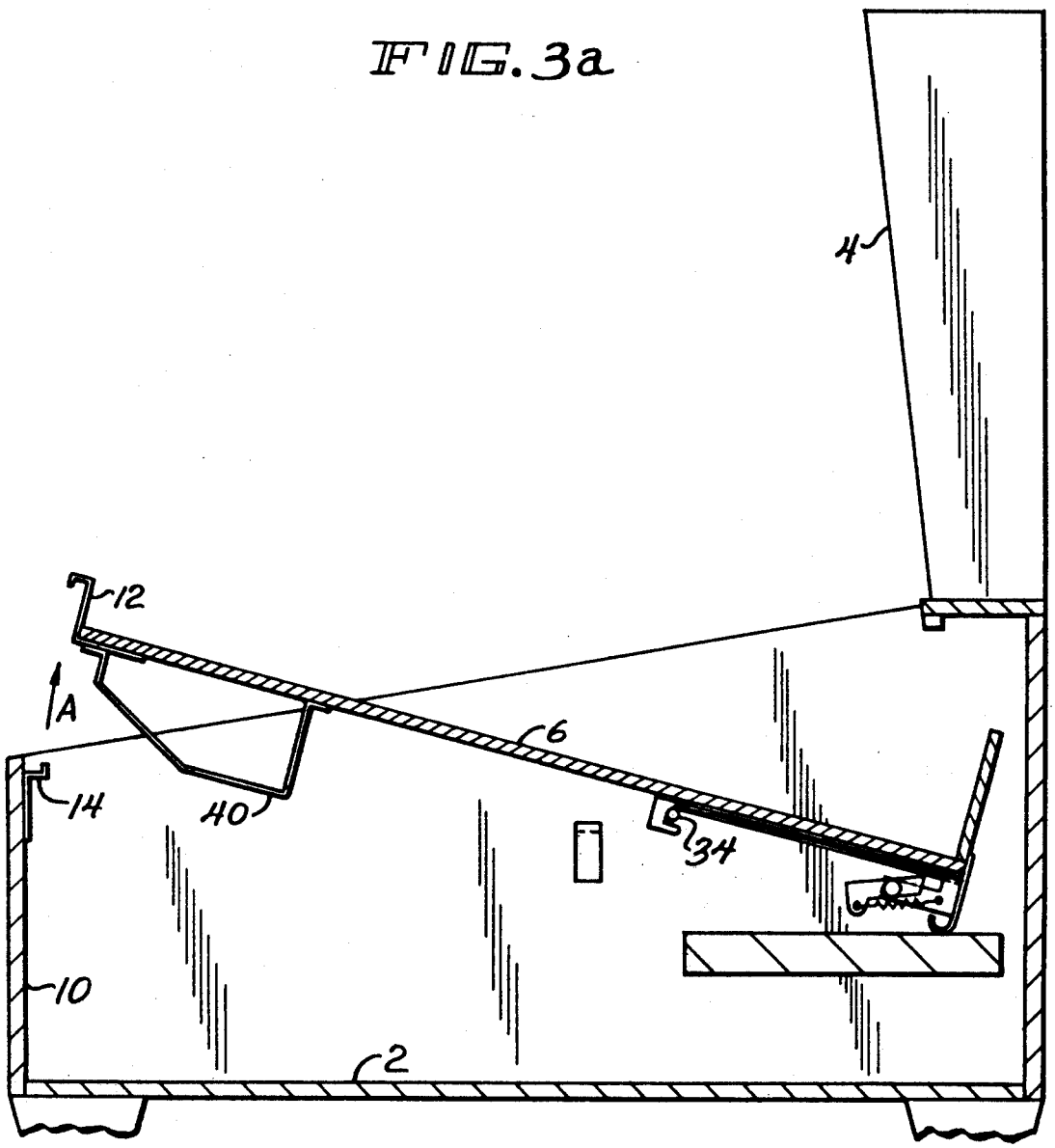
FIGS. 3*a*–3*d* are views showing the operation of the moving pivot as the playfield is raised and lowered.
Figure 3B:
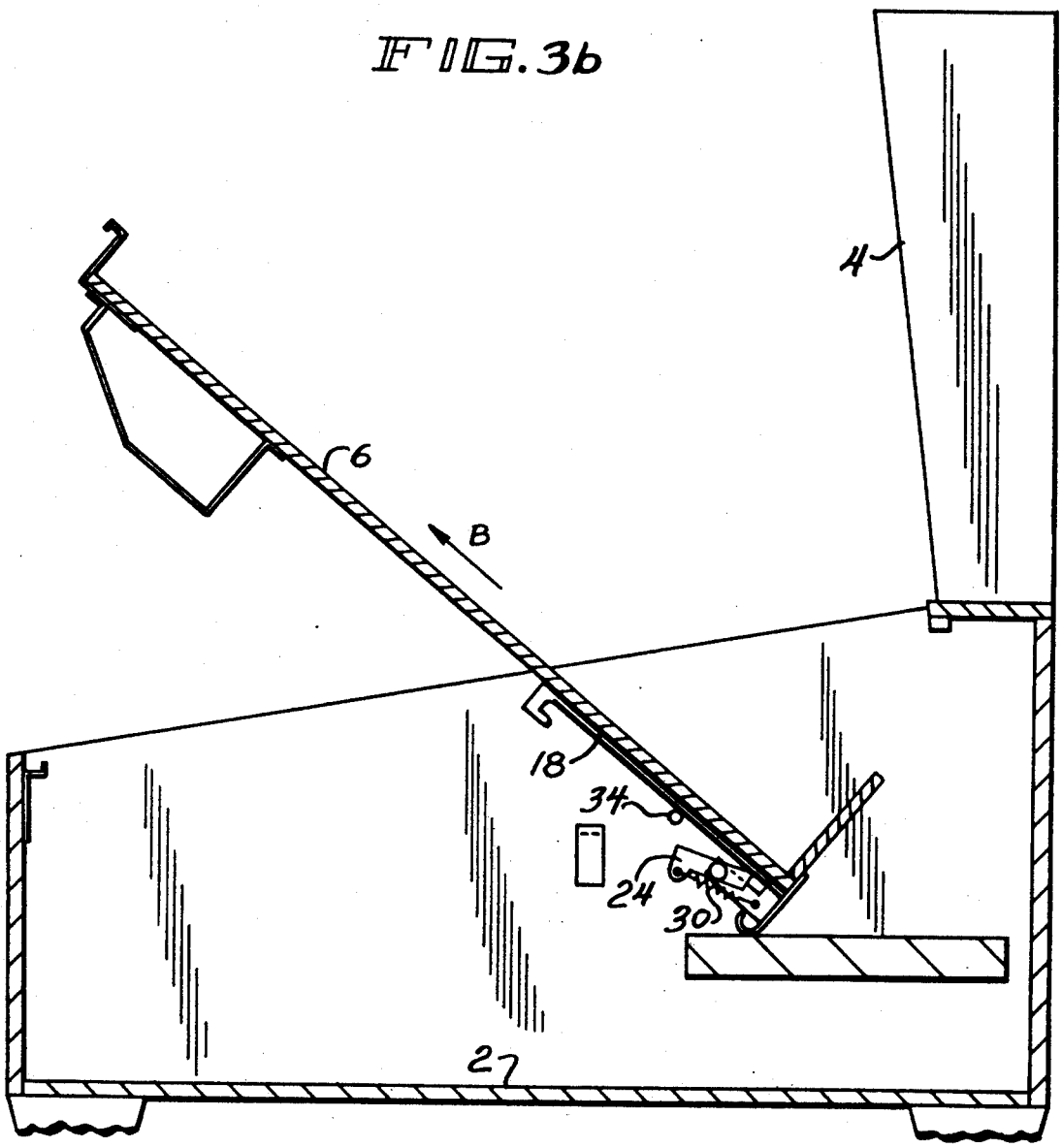
Figure 3C:
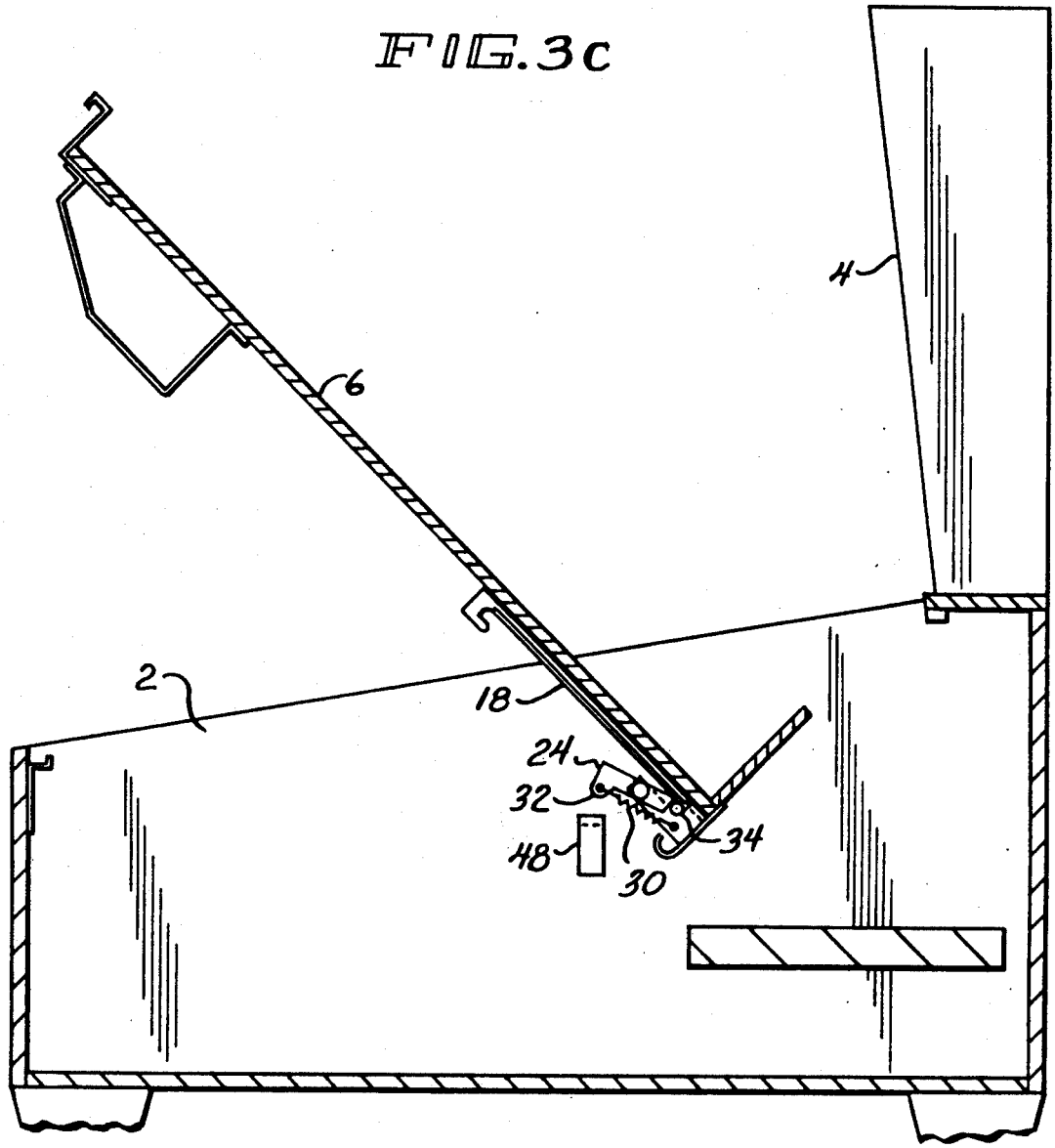
Figure 3D:
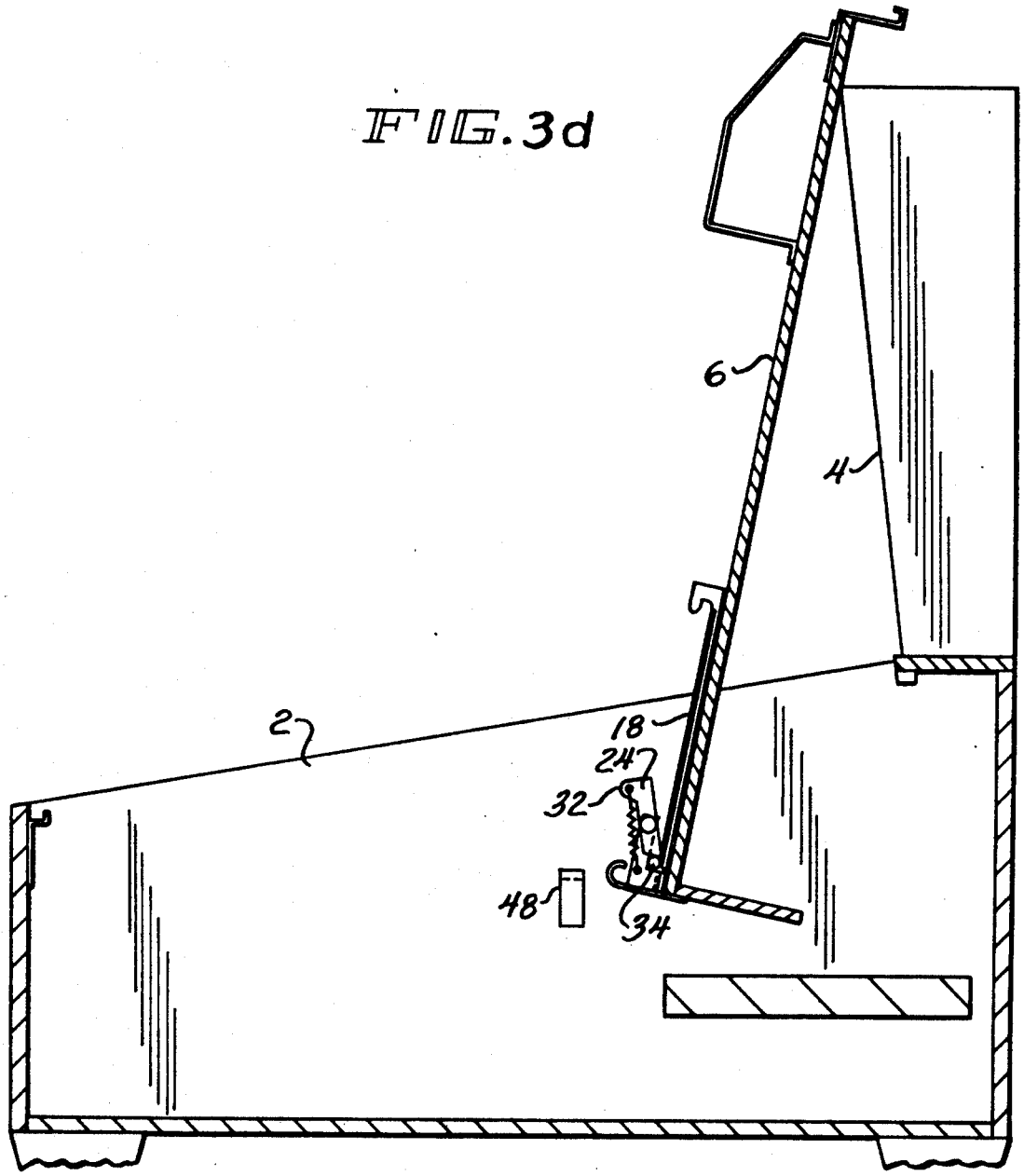

Referring more particularly to FIGS. 1 and 2, the pinball game of the invention consists of a game cabinet 2 that contains the electrical and mechanical components of the pinball game. A back box 4 is mounted to one end of the game cabinet 2 and provides art work, scoring and lighting displays and the like as will be understood by one skilled in the art. Legs 5 are provided to support the cabinet in an elevated position.

An inclined playfield 6 is provided which supports the rolling ball, a plurality of play features such a ramps, targets and bumpers, and the player-controlled flippers. The playfield encloses the interior of the cabinet such that only the playfield and back box are exposed. Cover glass 8 slidably engages slots 9 formed in the side walls of the cabinet (best shown in FIG. 2) such that it can be removed from the cabinet by sliding it in the slots. A removable plate (not shown) is secured to the top of the front wall 10 to retain the cover glass 8 in the position shown in FIG. 1 thereby to protect the playfield.

The system for mounting the playfield 6 to the cabinet 2 of the invention will now be described. Brackets 12 are fixed to the underside of playfield by any suitable fastener and extend above the playfield to releasably engage a mating bracket 14 fixed to the interior of wall 10. The engagement of brackets 12 and 14 retains the front end of playfield 6 in a recessed position relative to cabinet 2 as shown in the figures. Brackets 12 can be disengaged from brackets 14 by lifting playfield 6 in the direction of arrow A.

The opposite end of playfield 6 is supported by the moving pivot arrangement shown generally at 16. It should be understood that identical pivot arrangements are used on both sides of playfield 6, but for clarity, reference will be made only to one of the arrangements. A rail 18 is fixed to the underside of playfield 6 at the edge thereof. Rail 18 has a sliding surface 20 and terminates in stop 21. Stop 21 includes a portion 23 that underlies pin 34 when the playfield is in the lowered position of FIG. 1 to prevent the playfield from inadvertently moving upward during play of the game or transporting of the machine. Located on rail 18 at the end opposite stop 21 is a locking mechanism 22 consisting of a support bracket 24 extending form rail 18. Support bracket 24 pivotably supports a locking finger 26 at pivot 28. The weight of finger 26 is distributed such that the finger will assume the closed position shown in FIG. 1 due to the force of gravity. A tension spring 30 can also be provided between the end of finger 26 and support bracket 24 to further ensure that finger 26 will assume the illustrated position. Finger 26 terminates in an enlarged portion 32 that acts as a cam follower to pivot the locking finger 26 to its open position as will hereinafter be described.

A support pin 34 is fixed to the side wall 35 of cabinet 2 and extends into the interior thereof such that rail 18 rests on the pin. Preferably pin 34 consists of a bolt 36 having a cylinder locking member 38 fixed thereto to provide a bearing surface for rail 18 as best shown in FIG. 2. Sliding surface 20 of rail 18 rests on pin 34 to support the back end of the playfield 6. Moreover, the pin 34 provides a bearing surface over which surface 20 slides when the playfield is removed as will hereinafter be described.

Because the playfield features that are mounted on playfield 6 can extend below the playfield and are susceptible to damage, bumpers 40 and 42 are provided to prevent inadvertent contact between the play features and the cabinet structure 44 or the coin box 46, for example.

The removal of the playfield will be described with particular reference to FIGS. 1, and *3a–3d*. The pinball machine of FIG. 1 is shown in the configuration it would assume during normal play conditions, i.e. the playfield 6 is supported by brackets 14 and pins 34 and cover glass 8 is secured in cabinet 2 over playfield 6. To open the cabinet the glass plate is removed from the cabinet 2 by sliding it from the supporting slots 9 formed in the sidewalls of cabinet 2.

The front end of the playfield is then lifted vertically in the direction of arrow A, disengaging bracket 12 from bracket 14, to a position where playfield 6 is above front wall 10. As the front end of playfield 6 is lifted, the playfield pivots about pin 34. Once the front end of playfield 6 and bumpers 40 clear wall 10, the playfield is pulled in the direction of arrow B as it continues to be pivoted about pin 34, as shown in FIG. *3b*. As playfield 6 is pulled in the direction of arrow B, rail 18 slides along pin 34 until pin 34 engages finger 24 forcing it to move clockwise, against the force of spring 30. When pin 34 reaches the position shown in FIG. *3c*, finger 24 will pivot counter-clockwise to lock finger 24 in the illustrated position. The playfield may continue to be rotated until it rests against back box 4 as shown in FIG. *3d*. In this position the playfield will remain open to completely expose its underside and the interior of the cabinet.

To lower playfield 6 the above-described procedure is reversed. As playfield 6 is lowered, cam follower 32 will contact cam surface 48, which is fixed to the wall of the cabinet 2, to rotate finger 24 to the open position. Thereafter, the playfield is pushed in a direction opposite arrow B as it is lowered until it reaches the closed position of FIG. 1.

As will be apparent from the above disclosure, the moving pivot of the invention allows the playfield to be pivoted through an angle of at least 90° to completely expose the underside of the playfield and the interior of the cabinet. Moreover, because the top portion of the playfield is moved away from the back box as it is pivoted, taller play features can be accommodated. Finally, the playfield will remain open without the need for a separate prop although one may be provided to permit securing the playfield in the traditional service position if desired.

While the pinball game cabinet of the invention has been described in some detail with reference to the figures, numerous changes and modifications will be apparent without departing from the spirit and scope of the invention.

What is claimed is:

1. A pinball game cabinet permitting improved access for servicing, comprising:

a) a cabinet;

b) a playfield having components requiring periodic servicing on the underside thereof;

c) first means for releasably securing a first end of the playfield to the cabinet; and d) second means for securing the opposite end of the playfield to the cabinet including a support means secured to the cabinet slidably engaged with a slide means secured to the playfield whereby the slide means can pivot about the support means and can reciprocate relative to the support means whereby the interior of the cabinet and the underside of the playfield are exposed.

2. The pinball game cabinet according to claim 1, further including a locking means for releasably locking the support means relative to the slide means such that the playfield is prevented from reciprocating movement.

3. The pinball game according to claim 1, wherein the cabinet includes a side wall and the support means includes a pin fixed to the side wall of the cabinet.

4. The pinball game cabinet according to claim 1, wherein the slide means includes a rail fixed to the underside of the playfield, said rail resting on said support means.

5. The pinball game cabinet according to claim 4, wherein said rail has a stop means at a first end thereof for limiting the reciprocating movement of the playfield in a first direction.

6. The pinball game cabinet according to claim 4, further including a locking means at a second end of the rail, said locking means including means for releasably engaging said support means when said playfield is reciprocated.

7. The pinball game cabinet according to claim 6, wherein said locking means includes a pivotable finger for releasably engaging said support means and a camming surface for engaging said finger to release said support means.

8. The pinball game cabinet according to claim 1, wherein said first means includes a first bracket fixed to said playfield and a second bracket fixed to said cabinet, said first and second brackets being disengaged when said playfield is moved away from said cabinet.

9. In a rolling ball game, including a cabinet, a substantially horizontally disposed playfield having components requiring a periodic servicing on the underside thereof and a back box at one end of the playfield, the improvement comprising:

a) pivot means disposed on said cabinet on one end of the playfield for supporting said one end of the playfield thereon in the substantially horizontal position;

b) slide means disposed along the underside of the playfield for engaging said pivot means to permit (i) rotational movement of the playfield about the pivot means and (ii) translational movement toward and away from the back box;

c) means for releasably securing said slide means to said pivot means to support the playfield thereon when the playfield is rotated to a substantially vertical position;

whereby, better access is provided to the components on the underside of the playfield.

10. The ball game according to claim 9, wherein the pivot means includes a pin fixed to the wall of the cabinet.

11. The ball game according to claim 9, wherein the slide means includes a rail fixed to the underside of the playfield, said rail resting on said pivot means.

12. The ball game according to claim 11, wherein said rail has a stop means at a first end thereof for limiting the reciprocating movement of the playfield in a first direction.

13. The ball game according to claim 9, wherein said means for releasably securing includes a pivotable finger for releasably engaging said pivot means and a camming surface for engaging said finger to release said pivot means.

14. The ball game according to claim 9, further including a first bracket fixed to said playfield and a second bracket fixed to said cabinet for supporting an opposite end of the playfield, said first and second brackets being disengaged when said playfield is rotated about said pivot means.

15. A pinball game cabinet permitting improved access for servicing, comprising:

a) a cabinet;

b) a playfield having components requiring periodic servicing located under the playfield;

c) first means for releasably securing a first end of the playfield to the cabinet; and d) second means for securing the opposite end of the playfield to the cabinet allowing said playfield to pivot about a point and to reciprocate relative to the point in a linear direction.

* * * * *